US010030464B2

(12) United States Patent
Okura et al.

(10) Patent No.: US 10,030,464 B2
(45) **Date of Patent: *Jul. 24, 2018**

(54) MEMBER FOR HYDROCARBON RESOURCE COLLECTION DOWNHOLE TOOL

(71) Applicant: KUREHA CORPORATION, Tokyo (JP)

(72) Inventors: Masayuki Okura, Tokyo (JP); Hikaru Saijo, Tokyo (JP); Katsumi Yoshida, Tokyo (JP); Hiroyuki Sato, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/984,667

(22) Filed: Dec. 30, 2015

(65) Prior Publication Data

US 2016/0108696 A1 Apr. 21, 2016

Related U.S. Application Data

(63) Continuation of application No. 14/395,654, filed as application No. PCT/JP2013/061075 on Apr. 12, 2013, now Pat. No. 9,267,351.

(30) Foreign Application Priority Data

Jun. 7, 2012 (JP) ..... 2012-130055

(51) Int. Cl.
*E21B 33/12* (2006.01)
*E21B 23/14* (2006.01)
(Continued)

(52) U.S. Cl.
CPC ..... *E21B 33/12* (2013.01); *E21B 17/04* (2013.01); *E21B 23/14* (2013.01); *E21B 23/04* (2013.01); *E21B 2023/008* (2013.01)

(58) Field of Classification Search
CPC ..... E21B 33/12; E21B 17/04; E21B 23/14; E21B 23/04; E21B 2023/008
See application file for complete search history.

(56) References Cited

U.S. PATENT DOCUMENTS 7,093,664 B2 8/2006 Todd et al.
7,353,879 B2 4/2008 Todd et al.
(Continued)

FOREIGN PATENT DOCUMENTS

CN 1708632 A 12/2005
CN 101351523 A 1/2009
(Continued)

OTHER PUBLICATIONS

Mar. 24, 2016 Office Action issued in Chinese Office Action 201380013534.1.
(Continued)

*Primary Examiner* — Brad Harcourt
(74) *Attorney, Agent, or Firm* — Oliff PLC

(57) ABSTRACT

A downhole tool member for hydrocarbon resource recovery, comprising a shaped body of a polyglycolic acid resin having a weight average molecular weight of at least 70,000, having an effective thickness which is ½ or more of a critical thickness of surface decomposition, and exhibiting a thickness reduction rate in water which is constant with respect to time. As a result, it has become possible to more accurately design the strength and time up to the collapse of the downhole tool member which forms the whole or a part of a downhole tool for developing or repairing downholes for recovery of hydrocarbon resources, such as oil and gas.

27 Claims, 2 Drawing Sheets

(51) Int. Cl.

| | |
|---|---|
| ***E21B 17/04*** | (2006.01) |
| *E21B 23/04* | (2006.01) |
| *E21B 23/00* | (2006.01) |

(56) References Cited

U.S. PATENT DOCUMENTS

| | | | | |
|---|---|---|---|---|
| 7,621,336 | B2 | 11/2009 | Badalamenti et al. | |
| 7,762,342 | B2 | 7/2010 | Richard et al. | |
| 8,714,250 | B2 | 5/2014 | Baser et al. | |
| 9,267,351 | B2 * | 2/2016 | Okura | E21B 33/12 |
| 2003/0125508 | A1 | 7/2003 | Yamane et al. | |
| 2004/0106525 | A1 | 6/2004 | Willberg et al. | |
| 2004/0152601 | A1 | 8/2004 | Still et al. | |
| 2005/0113263 | A1 | 5/2005 | Brown et al. | |
| 2005/0205265 | A1 | 9/2005 | Todd et al. | |
| 2005/0205266 | A1 | 9/2005 | Todd et al. | |
| 2006/0042797 | A1 | 3/2006 | Fredd et al. | |
| 2006/0058197 | A1 | 3/2006 | Brown et al. | |
| 2006/0113077 | A1 | 6/2006 | Willberg et al. | |
| 2006/0229212 | A1 | 10/2006 | Willberg et al. | |
| 2006/0283591 | A1 | 12/2006 | Willberg et al. | |
| 2007/0289743 | A1 | 12/2007 | Willberg et al. | |
| 2008/0200352 | A1 | 8/2008 | Willberg et al. | |
| 2008/0236823 | A1 | 10/2008 | Willberg et al. | |
| 2008/0289823 | A1 | 11/2008 | Willberg et al. | |
| 2009/0025940 | A1 | 1/2009 | Rytlewski | |
| 2010/0032151 | A1 | 2/2010 | Duphorne | |
| 2011/0056684 | A1 | 3/2011 | Willberg et al. | |
| 2012/0267103 | A1 | 10/2012 | Willberg et al. | |
| 2013/0192839 | A1 | 8/2013 | Brown et al. | |
| 2013/0240203 | A1 * | 9/2013 | Frazier | E21B 33/129 166/193 |

FOREIGN PATENT DOCUMENTS

| | | | |
|---|---|---|---|
| EP | 2 873 800 | A1 | 5/2015 |
| JP | 2005/534746 | A | 11/2005 |
| JP | 2008-088364 | A | 4/2008 |
| WO | 03/037956 | A1 | 5/2003 |
| WO | 2004/011530 | A1 | 2/2004 |
| WO | 2004/013251 | A1 | 2/2004 |

OTHER PUBLICATIONS

Apr. 26, 2017 Office Action issued in European Patent Application No. 13 801 222.4.

Bratton, Daniel, et al., "Synthesis of poly(glycolide) in supercritical carbon dioxide in the presence of a hydrocarbon stabiliser". Chemical Communications-Chemcom, vol. 7, Jan. 1, 2004.

Wolf, Florian, et al., "Poly(glycolide) multi-arm star polymers: Improved solubility via limited arm length," Beilstein Journal of Organic Chemistry, vol. 6, Jan. 1, 2010.

Anonymous: "Synthetic Biodegradable Polymers as Medical Devices," MDDI Medical Device and Diagnostic Industry News Products and Suppliers, Mar. 1, 1998.

Jul. 16, 2013 Search Report issued in International Application No. PCT/JP2013/061075.

U.S. Appl. No. 14/395,654, filed Oct. 20, 2014 in the name of Okura et al.

Dec. 7, 2015 Search Report issued in European Application No. 13801222.4.

Burkersroda et al., "Why degradable polymers undergo surface erosion or bulk erosion," Biomaterials, vol. 23, No. 21, Nov. 1, 2002, pp. 4221-4231.

Chen et al., "Mathematical modeling of degradation for bulk-erosive polymers: Applications in tissue engineering scaffolds and drug delivery systems," vol. 7, No. 3, Sep. 28, 2010, pp. 1140-1149.

Feb. 27, 2018 Office Action issued in European Patent Application No. 13 801 222.4.

* cited by examiner

MEMBER FOR HYDROCARBON RESOURCE COLLECTION DOWNHOLE TOOL

This application is a Continuation of U.S. application Ser. No. 14/395,654, filed Oct. 20, 2014, which is a National Phase of PCT/JP2013/061075, filed Apr. 12, 2013, which in turn claims priority to JP 2012-130055, filed Jun. 7, 2012. The contents of the prior applications are hereby incorporated by reference herein in their entirety.

TECHNICAL FIELD

The present invention relates to a member which forms a tool per se or a component thereof for formation or repair of downholes for recovery of hydrocarbon resources including oil and gas.

BACKGROUND ART

Downholes (underground drilling pits) are prepared for recovery of hydrocarbon resources including oil and gas (representatively called "oil" sometimes hereafter) from the underground. Downhole tools such as frac plugs (disintegratable plugs), bridge plugs, cement retainers, perforation guns, ball sealers, sealing plugs, and packers (inclusively referred to as "downhole tools" hereafter), are used for the formation or repair of the downholes. Thereafter, the tools are often disintegrated or allowed to fall down without recovery onto the ground. (Examples of such downhole tools and manners of use thereof are illustrated in, e.g., Patent documents 1-5). Therefore, it has been recommended to form the whole or a component thereof constituting a bonding part allowing collapse (i.e. downhole tool member) with a degradable polymer for the tool of such temporary use. Examples of the degradable polymer may include: polysaccharide, such as starch or dextrin; animal albumin polymers, such as chitin and chitosan; aliphatic polyesters, such as polylactic acid (PLA, typically poly L-lactic acid (PLLA)), polyglycolic acid (PGA), polybutyric acid, and polyvaleric acid; and further, polyamino acids, polyethylene oxide, etc. (Patent documents 1 and 2). However, the technology of designing the change of mechanical strength under degradation and time to collapse of the downhole tool member by using the degradable polymer has not been satisfactorily developed because it was difficult to accurately evaluate the degradation behavior of the degradable polymer.

PRIOR ART DOCUMENTS

Patent Documents

[Patent document 1] US2005/0205266A,
[Patent document 2] US2005/0205265A,
[Patent document 3] US2009/0101334A,
[Patent document 4] U.S. Pat. No. 7,621,336B,
[Patent document 5] U.S. Pat. No. 7,762,342B.

SUMMARY OF INVENTION

In view of the above-mentioned conventional state of art, a principal object of the present invention is to provide a downhole tool member which allows more accurate designing of the change of mechanical strength under degradation and time until the collapse through suitable selection and shaping of a degradable polymer.

Having been developed for achieving the above-mentioned object, the downhole tool member for hydrocarbon resource recovery of the present invention, comprises: a shaped body of a polyglycolic acid resin having a weight-average molecular weight of at least 70,000, has an effective thickness which is ½ or more of a critical thickness of surface decomposition, and exhibits a constant thickness reduction rate (velocity) in water with respect to time.

According to the present inventors' study, polyglycolic acid resin has an excellent initial strength, and its appropriately designed shaped body exhibits a unique characteristic, that is, a constant thickness reduction rate with time (a linear thickness reduction rate, in other words) in water, unlike other degradable polymers. Therefore, if an effective thickness, which contributes to required characteristics such as the strength the body and the plugging or sealing performance of a downhole tool member, is appropriately set depending on the time up to collapse of the component, it becomes possible to design the strength and retention time of the downhole tool member. The linear thickness reduction rate of the shaped body of polyglycolic acid resin is attained based on the surface decomposition of the shaped body because of an excellent water (vapor) barrier property (in other words, a phenomenon that a boundary between a hydrolyzed low-molecular weight polymer layer, which does not show a barrier property, and an un-hydrolyzed core layer in the shaped body proceeds inwardly at a rate which is almost consistent to the rate of water molecules permeating from the surface and such rate is the rate-controlling step). The linear thickness reduction rate is not attained in bulk decomposition shown in degradation of fine particles of polyglycolic acid resin which do not form such a clear boundary or in degradation of the shaped body of other degradable polymers which exhibit inferior barrier properties. For example, a shaped body of polylactic acid, as a typical degradable polymer, shows an effective thickness reduction rate which is initially slow but rapidly increases from an intermediate stage (as shown in Comparative Example 1). In the present invention, an effective thickness (a thickness of a portion of the shaped body as a tool member governing the property) of the shaped body of a polyglycolic acid resin is set to have at least a critical thickness that is a boundary thickness that the bulk decomposition is shifted to surface decomposition, or at least a half of the critical thickness in case where only one surface of the shaped body is exposed to water, whereby it has become possible to design a downhole tool member having a linear thickness reduction rate characteristic.

BEST MODE FOR PRACTICING THE INVENTION

Figure 1:
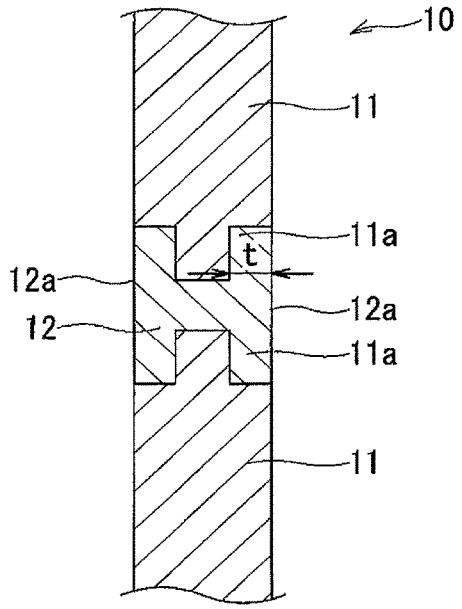
FIG. 1 is a schematic sectional view of a relevant part of a frac plug as an example of a downhole tool.

Hereinafter, the present invention will be described in detail with reference to suitable embodiments thereof.

(Polyglycolic Acid Resin)

Polyglycolic acid resin used in the present invention may include glycolic acid homopolymer (namely, polyglycolic acid (PGA)) consisting only of a glycolic acid unit (—$OCH_2$—CO—) as a repeating unit, and also a glycolic acid copolymer which includes other monomer (comonomer) units, such as hydroxyl carboxylic acid units, preferably lactic acid units, in a proportion of at most 50 wt. %, preferably at most 30 wt. %, further preferably at most 10 wt. %. The hydrolysis rate, crystallinity, etc., of polyglycolic acid resin can be modified to some extent by converting it into a copolymer including another monomer unit. However, it should be noted that the surface decomposition characteristic of the downhole tool member of the present invention is attained based on the outstanding barrier property of polyglycolic acid resin, so that the introduction in excessive amount of another monomer unit is undesirable because it is liable to impair the barrier property and results in a loss of the linearity of thickness reduction rate.

Polyglycolic acid resin having a weight-average molecular weight of at least 70,000, preferably 100,000-500,000, is used. If the weight-average molecular weight is below 70,000, the initial strength required of a tool member is impaired. On the other hand, if the weight-average molecular weight exceeds 500,000, the polyglycolic acid resin is liable to have undesirably inferior molding and processing characteristics.

In order to obtain polyglycolic acid resin of such a large molecular weight, rather than polymerization of glycolic acid, it is preferred to adopt a process of subjecting glycolide which is a dimer of glycolic acid to ring-opening polymerization in the presence of a small amount of catalyst (cation catalyst, such as organo-tin carboxylate, tin halide, or antimony halide) and substantially in the absence of a solvent (namely, under bulk polymerization conditions) under heating at temperatures of about 120-250° C. Accordingly, in case of forming a copolymer, it is preferred to use as a comonomer one or more species of lactides, as represented by lactide which is a dimer of lactic acid, and lactones (e.g., caprolactone, beta-propiolactone, beta-butyrolactone).

Incidentally, the melting point (Tm) of polyglycolic acid resin is generally 200° C. or higher. For example, polyglycolic acid has a melting point of about 220° C., a glass transition temperature of about 38° C., and a crystallization temperature of about 90° C. However, the melting point of the polyglycolic acid resin can vary to some extent depending on the molecular weight thereof, comonomer species, etc.

Although the downhole tool member of the present invention is usually composed of the polyglycolic acid resin alone, it is also possible to blend other aliphatic polyesters (e.g., homopolymer or copolymer of comonomers for giving the glycolic acid copolymer described above) or other thermoplastic resins, such as aromatic polyesters or elastomers, for the purpose of controlling the degradability, etc. However, the blending amount thereof should be suppressed not to impair the above-mentioned surface decomposition characteristic of the shaped body based on the gas-barrier property of the polyglycolic acid resin. More specifically, the blending amount should be suppressed in amount not obstructing the presence of the polyglycolic acid resin as the matrix resin, i.e., less than 30 wt. %, preferably less than 20 wt. %, more preferably less than 10 wt. %, of the polyglycolic acid resin.

To the polyglycolic acid resin, it is further possible to add various additives, such as thermal stabilizer, light stabilizer, inorganic filler, plasticizer, desiccant, waterproofing agent, water repellent, lubricant, degradation accelerator, and degradation retarder, as needed, within an extent not adverse to the object of the present invention.

The polyglycolic acid resin (and other optional components) obtained in the above-described manner may be formed, by a conventional thermoforming method, such as injection molding, melt-extrusion, solidification extrusion, compression molding and centrifugal molding, or if needed, further by machining, into the shape of a member or article constituting the whole or a component of various downhole tools, such as frac plugs, bridge plugs, cement retainers, perforation guns, ball sealers, sealing plugs, and packers, as exemplified in the above-mentioned Patent documents 1-5. For instance, in order to improve the controllability of the collapse time of a tool based on linearity of thickness reduction rate, the polyglycolic acid resin may be formed into a component 12 constituting a connecting part between components 11-11 made of non-water-degradable resin or metal, which is in a shape of a cylinder, a rectangular column or a hollow bar, to form a tool 10 having an slender shape, as shown in FIG. 1 which is a schematic cross-sectional view of a relevant part of a frac plug as an example of a downhole tool. As a result, a thickness t from a surface 12*a* of the component 12 exposed to water (more practically, an aqueous medium forming a work environment in which the downhole tool is placed) to a side of a projection part 11*a* of the component 11 becomes an effective thickness, which will govern the time until the collapse or disintegration of the tool 10. Depending on the shape of a tool, only one surface thereof can be exposed to water. In such a case, the effective thickness becomes a half of the critical thickness. Moreover, in the case of a ball sealer which has a whole shape of a sphere and is entirely exposed to water, the diameter of the sphere may be taken as an effective thickness.

It is also preferred that the obtained shaped body of polyglycolic acid resin is subjected to a heat treatment for about 1 minute to 10 hours at a temperature which is above the crystallization temperature Tc1 on temperature increase (about 90° C. for glycolic acid homopolymer) and below the melting point of the polyglycolic acid resin, to improve the weight-basis crystallinity to about 20% or more, especially 30 to 60%, thereby improving the water vapor barrier-property and the linearity of thickness reduction rate.

(Critical Thickness of Surface Decomposition)

In the present invention, the effective thickness of the polyglycolic-acid-resin shaped body constituting a downhole tool member is set to at least ½ of the critical thickness of surface decomposition. According to the present inventors' study, the critical thickness Lc of surface decomposition has been determined as follows.

Generally, decomposition of a shaped body of an ordinary degradable resin showing a faster water penetration rate into the shaped body than the rate of the decomposition of the resin proceeds by bulk decomposition mechanism, and the decomposition rate does not show linearity. On the other hand, in the case where the water penetration rate is slower than the resin decomposition rate, decomposition proceeds by surface decomposition mechanism and the thickness reduction rate accompanying the decomposition shows linearity. Although PGA resin satisfies this condition, a thin shaped body thereof still causes bulk decomposition, since the penetration of water into the shaped body occurs quickly. A thickness at which the bulk decomposition changes to the surface decomposition is called a critical thickness Lc. The present inventors have confirmed the surface-decomposition characteristic of polyglycolic acid homopolymer (PGA), as shown in Examples described hereafter and have determined the critical thickness as follows.

First, fine powder (having an average particle size of 200 μm) of PGA was used to investigate a relation between the molecular weight change and the weight loss in water. As a result, it was found that when the weight-average molecular weight (Mw) measured by GPC reached 50,000, the fine powder started to cause a weight loss. Time (i) until the weight-average molecular weight of the PGA fine powder having an initial Mw=200,000 fell down to 50,000 was measured at various temperatures, as follows: 278 hours in water at 40° C., 57 hours in water at 50° C. and 14 hours in water at 80° C. As an empirical formula based on measured values at more temperatures, the Mw=50,000-arrival time (τ) at an absolute temperature (K) is given by the following formula (1).

$$\tau=\exp(8240/K-20.7) \quad (1)$$

Figure 2:
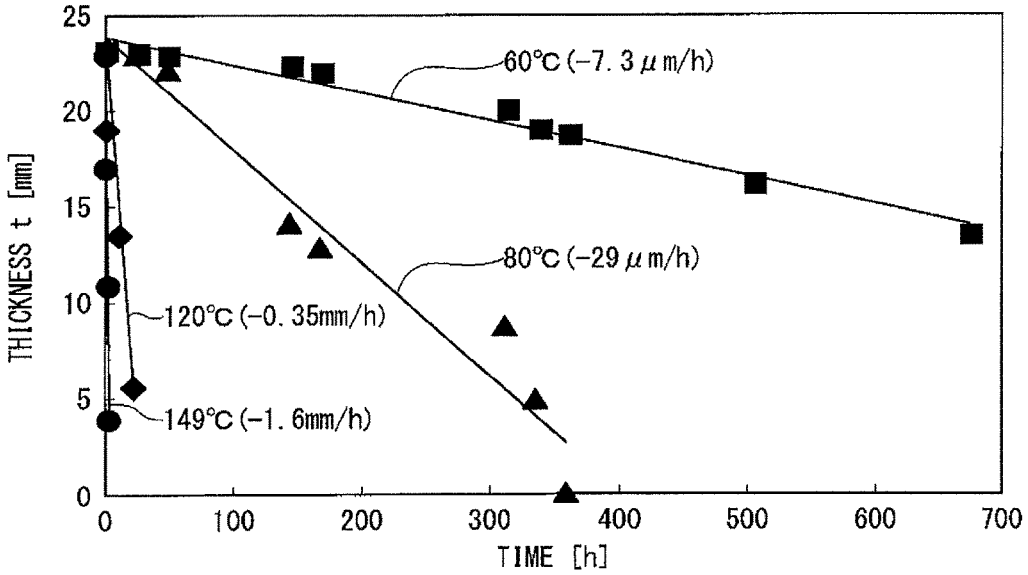
FIG. 2 is a graph showing changes in thickness with time of PGA-shaped body at various temperatures.

Subsequently, a molded piece of PGA (23 mm in thickness) was used to investigate the thickness reduction rate (Example 1 described later). As a result, it showed a thickness (one side) reduction rate which was constant with time (FIG. 2). Moreover, it was found that the molecular weight of the undecomposed portion was not different from the molecular weight before the decomposition, and the molded piece decomposed by the surface-decomposition mechanism. Since the penetration rate of water is a ruling factor of the decomposition rate in this instance, it can be said that a thickness reduction rate (decomposition rate) is equivalent to the water penetration rate. From the above, the thickness-reduction-rate (=penetration rate of water) (V) of the PGA molded piece was 1.15 μm (each value counted as penetration from one side)/hour in water at 40° C., 5.95 μm/hour in water at 60° C. and 28.75 μm/hour in water at 80° C. As an empirical formula based on measured values at more temperatures, the thickness reduction rate (V) (one side) at an absolute temperature (K) is given by the following formula (2). (The above is based on Example 1 described later).

$$V=\exp(21.332-8519.7/K) \quad (2)$$

A thickness of a material at which the bulk decomposition changes to the surface decomposition is called a critical thickness (of surface decomposition) Lc. The critical thickness Lc of the material can be estimated from the following formula (3) based on the results of the above formulae (1) and (2) at respective temperatures (K).

$$\text{Critical-thickness } Lc=2\times\tau\times V \quad (3)$$

As a result, the critical thickness (τ) of PGA was obtained as 770 μm in water at 40° C., 812 μm in water at 60° C. and 852 μm in water at 80° C.

Based on the above formulae (1)-(3), the critical thickness Lc of the surface decomposition of PGA was calculated as shown in the following Table 1.

TABLE 1

| Temperature (° C.) | Decomposition start time τ (h) | Water penetration rate V (mm/h) | Critical thickness Lc (μm) |
|---|---|---|---|
| 40 | 2.78E+02 | 1.4E−03 | 770 |
| 60 | 5.71E+01 | 7.1E−03 | 812 |
| 80 | 1.41E+01 | 3.0E−02 | 852 |
| 100 | 4.02E+00 | 1.1E−01 | 889 |
| 120 | 1.31E+00 | 3.5E−01 | 923 |
| 140 | 4.73E−01 | 1.0E+00 | 956 |
| 160 | 1.88E−01 | 2.6E+00 | 986 |

Therefore, it has been found that when the shaped body of PGA has a thickness exceeding these values, the decomposition of the shaped body with both sides exposed in water proceeds by the surface decomposition which shows a linear thickness reduction rate during the decomposition. As mentioned above, in the present invention, by setting the effective thickness of the polyglycolic-acid-resin shaped body constituting a downhole tool member to at least ½ times, preferably at least 1 times the critical thickness (τ) of surface decomposition which is determined by environmental conditions, mainly temperature, in the downhole, it becomes possible to design the disintegration time of a downhole tool based on the linearity of thickness reduction rate of the downhole tool member.

(Effective Thickness)

The effective thickness of shaped body of the PGA resin forming a downhole tool member is defined as a reduction thickness which will be permitted by the time when the required characteristics (e.g., a bonding strength for a connecting member and a plugging or sealing function for a plug or a sealer) of the downhole tool member are lost. The effective thicknesses of a tool member is set to be at least 1 times the critical thickness when two major surfaces of the downhole tool member is exposed and at least ½ times the critical thickness when only one of two major surfaces of the downhole tool member is exposed, respectively, to the aqueous medium forming the operation environment. In either case, it is generally preferred that the effective thickness is set to at least 1.2 times, further preferably at least 1.5 times, the above-mentioned value.

The downhole tool member of the present invention is formed in an effective thickness which is designed to be at least the above-mentioned value and to be spontaneously degraded after being used in an environmental aqueous medium at a prescribed temperature of, e.g., 20-180° C. for operations, such as formation, repair and enlargement of downholes. It is also possible, however, to accelerate the collapse thereof after use, as desired, by elevating the environmental temperature, e.g., by injecting hot steam.

EXAMPLES

Hereinafter, the present invention will be described more specifically based on Examples and Comparative Examples. The characteristic values disclosed in this specification including Examples described later are based on values measured according to the following methods.

<Weight-Average Molecular Weight (Mw)>

For measurement of the weight-average molecular weights (Mw) of the polyglycolic acid (PGA) and polylactic acid (PLA), each sample of 10 mg was dissolved in hexafluoroisopropanol (HFIP) containing sodium trifluoroacetate dissolved therein at a concentration of 5 mM to form a solution in 10 mL, which was then filtered through a membrane filter to obtain a sample solution. The sample solution in 10 μL was injected into the gel permeation chromatography (GC) apparatus to measure the molecular weight under the following conditions. Incidentally, the sample solution was injected into the GPC apparatus within 30 minutes after the dissolution.

<GPC Conditions>

Apparatus: Shimadzu LC-9A,

Column: HFIP-806M×2 (series connection)+Pre-column: HFIP-LG×1

Column temperature: 40° C.,

Elution liquid: An HFIP solution containing 5 mM of sodium trifluoroacetate dissolved therein Flow rate: 1 mL/min.

Detector: Differential refractive index meter

Molecular-weight calibration: A calibration curve was prepared by using five standard molecular weight samples of polymethyl methacrylate having different molecular weights (made by POLYMER LABORATORIES Ltd.) and used for determining the molecular weights.

<Preparation of Molded Pieces>

Molded pieces for measurement of thickness reduction rate by immersion in water were prepared in the following manner from resin (compositions) of Examples and Comparative Examples described later.

A 5-mm-thick resin sheet was first produced by press molding using a mold frame of stainless steel measuring 5 cm-square and 5 mm in depth. The press conditions included a temperature of 260° C., preheating for 4 minutes, pressing at 5 MPa for 2 minutes, and the sheet after the press was quenched by water-cooled plates. Subsequently, several produced sheets were piled up and subjected to press molding, to form a molded piece of a predetermined thickness (12 mm or 23 mm). The press conditions included a temperature of 260° C., preheating for 7 minutes, pressing at 5 MPa for 3 minutes, and the sheet after the press was quenched by water-cooled plates. The thus-produced molded pieces were crystallized by heat treatment in an oven at 120° C. for 1 hour, and then used for the test.

(Decomposition Test in Water)

One of the molded resin pieces of obtained as described above was put in a 1 liter-autoclave, which was then filled with de-ionized water, to effect an immersion test for a prescribed time at a prescribed temperature. Then, the molded piece after the immersion was taken out and cut out to expose a section thereof, followed by standing overnight in a dry room to provide a dry piece. The thickness of the core part (hard undecomposed portion) thereof was measured, and based on a difference from the initial thickness, a reduced thickness ($\Delta t$=½ of the total reduced thickness from both sides) was calculated.

Example 1

Figure 3:
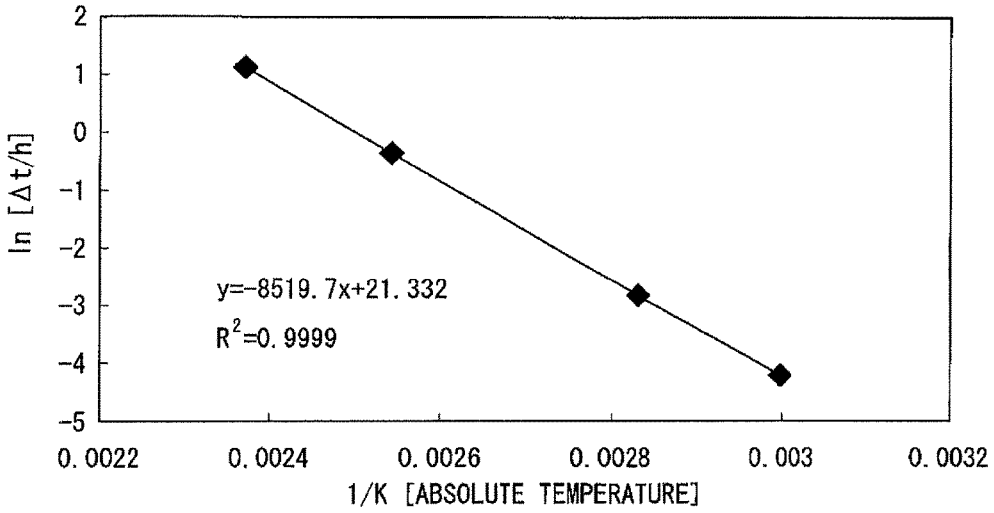
FIG. 3 is a graph (Arrhenius plot) showing temperature dependence of the thickness reduction rate of PGA shaped body.

A predetermined number of 23 mm-thick molded pieces were prepared from glycolic acid homopolymer having initial molecular weight Mw=200,000 (PGA, made by Kureha Corporation) in the above-described manner, and were respectively subjected to the decomposition test in water at temperatures of 60° C., 80° C., 120° C. and 149° C. as described above to measure the change with time of reduced thicknesses (one side) (=$\Delta t$). The results are plotted as shown in FIG. 2. In view of the plot in FIG. 2, a good linearity of thickness reduction rate is observed at each temperature. Based on the data of FIG. 2, an Arrhenius plot was obtained as shown in FIG. 3, wherein the ordinate represents a logarithmic value In ($\Delta t$/h) of the thickness change rate on one side, and the abscissa represents a reciprocal of absolute temperature (1/K). From the results, the formula (2) mentioned above (and reproduced below) showing the temperature dependence of thickness reduction rate (one side) (=V) was obtained.

$$V=\Delta t(\mathrm{mm})/h=\exp(21.332-8519.7/K) \quad (2)$$

Example 2

Four pieces of 12 mm-thick molded pieces were prepared from the same PGA as used in Example 1 in the above-described manner, and subjected to the above-mentioned decomposition test in water, respectively, at 149° C. to measure the change with time of thickness reduction.

Comparative Example 1

12 mm-thick molded pieces were prepared and subjected to the in-water decomposition test to measure the change with time of thickness reduction in the same manner as in Example 2 except for using a crystalline polylactic acid having a weight average molecular weight of 260,000 (PLLA, "Ingeo Biopolymer 4032D" made by Nature Works).

Figure 4:
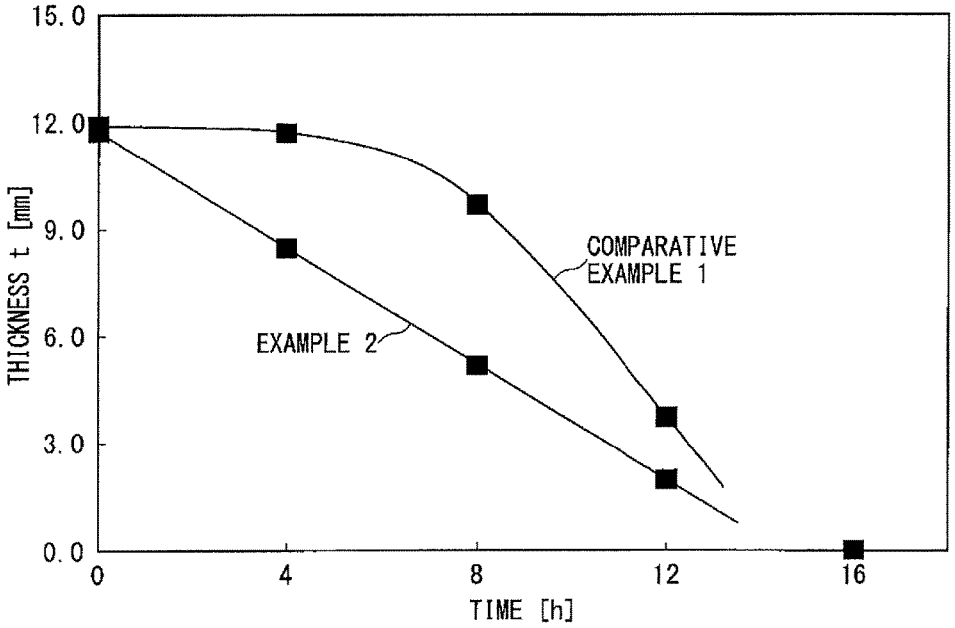
FIG. 4 is a graph showing data of thickness change with time for a PGA shaped body and a PLLA shaped body for comparison.

The results of the above-mentioned Example 2 and Comparative Example 1 are collectively shown in FIG. 4. As shown in FIG. 4, while PGA showed a good linearity of thickness reduction rate, the PLA molded piece of Comparative Example 1 showed a slow reduction rate at the beginning, but the thickness reduction rate increased rapidly from the intermediate stage, thus failing to show a linearity of thickness reduction rate.

Example 3

The in-water decomposition test was performed at 120° C., otherwise in the same manner as in Example 2.

Example 4

The decomposition test in water was performed in the same manner as in Example 2 except that an 800 ml-glass bottle was used as a vessel instead of the autoclave and was stored in an oven set at 80° C.

Example 5

The decomposition test in water was performed in the same manner as in Example 2 except that an 800 ml-glass bottle was used as a vessel instead of the autoclave and was stored in an oven set at 60° C.

Example 6

Molded pieces were prepared and the decomposition test in water was performed in the same manner as in Example 2 except that the molded pieces were prepared from a composition obtained by mixing 50 wt. parts of the same PGA as used in Example 1 with 50 wt. parts of talc ("Micro ace L-1", made by Nippon Talc, Co. Ltd.; 50% volume-basis average particle size=5 μm) as the raw material.

Example 7

Molded pieces were prepared and the decomposition test in water was performed in the same manner as in Example 2 except that the molded pieces were prepared from a composition obtained by mixing 50 wt. parts of the same PGA as used in Example 1 with 50 wt. parts of silica sand (silica sand No. 8, made by JFE Mineral Co. Ltd.; particle size range=150 to 212 μm) as the raw material.

Example 8

Molded pieces were prepared and the decomposition test in water was performed in the same manner as in Example 2 except that the molded pieces were prepared from a composition obtained by mixing 90 wt. parts of the same PGA as used in Example 1 with 10 wt. parts of the crystalline polylactic acid (PLLA) used in Comparative Example 1 as the raw material.

(Comparative Example 2) PGA/PLLA=70/30

Molded pieces were prepared and the decomposition test in water was performed in the same manner as in Example 2 except that the molded pieces were prepared from a composition obtained by mixing 70 wt. parts of the same PGA as used in Example 1 with 30 wt. parts of PLLA used in Comparative Example 1 as the raw material.

Comparative Example 3

Molded pieces were prepared and the decomposition test in water was performed in the same manner as in Example 2 except that the molded pieces were prepared from a composition obtained by mixing 50 wt. parts of the same PGA as used in Example 1 with 50 wt. parts of PLLA used in Comparative Example 1 as the raw material.

About Examples 3-8, the linearity of thickness reduction rate as shown in FIG. 4 was observed similarly as in Example 2. On the other hand, in Comparative Examples 2 and 3 using lager amounts of PLLA, the linearity of the thickness reduction rate was lost similarly as in Comparative Example 1.

The outline and results of the above-mentioned Examples 2-8 and Comparative Examples 1-3 are collectively shown in the following Table 2.

TABLE 2

| Example | Composition of molded piece (Weight basis) | Temperature (° C.) | Linearity of thickness reduction rate |
|---|---|---|---|
| 2 | PGA homopolymer | 149 | Yes |
| 3 | PGA homopolymer | 120 | Yes |
| 4 | PGA homopolymer | 80 | Yes |
| 5 | PGA homopolymer | 60 | Yes |
| 6 | PGA/talc = 50/50 | 149 | Yes |
| 7 | PGA/silica sand = 50/50 | 149 | Yes |
| 8 | PGA/PLLA = 90/10 | 149 | Yes |
| Comparative 1 | PLA homopolymer | 149 | No |
| Comparative 2 | PGA/PLLA = 70/30 | 149 | No |
| Comparative 3 | PGA/PLLA = 50/50 | 149 | No |

INDUSTRIAL APPLICABILITY

As described above, according to the present invention, there is provided a downhole tool member forming the whole or a part of a downhole tool which is a tool for forming or repairing downholes for recovery of hydrocarbon resources, such as oil and gas. The downhole tool member is formed as a shaped body of a polyglycolic acid resin having a weight average molecular weight of at least 70,000, has an effective thickness which is ½ or more of a critical thickness of surface decomposition, and exhibits a linear thickness reduction rate characteristic when placed in water, thereby allowing more accurate designing of strength and time up to the collapse thereof.

The invention claimed is:

1. A downhole tool for hydrocarbon resource recovery, consisting of a shaped body of a polyglycolic acid resin having a weight-average molecular weight of at least 70,000, having an effective thickness which is ½ or more of a critical thickness of surface decomposition, and exhibiting a constant thickness reduction rate in water with respect to time.

2. A downhole tool according to claim 1, wherein the shaped body of polyglycolic acid resin has a weight-basis crystallinity of 30-60%.

3. A downhole tool according to claim 2, wherein only one of two major surfaces of the shaped body of polyglycolic acid resin is exposed to an aqueous medium forming an operation environment and the effective thickness has been set to at least ½ of the critical thickness of surface decomposition.

4. A downhole tool according to claim 3, wherein the effective thickness has been set to at least ¾ of the critical thickness of surface decomposition.

5. A downhole tool according to claim 2, wherein both of two major surfaces of the shaped body of polyglycolic acid resin are exposed to an aqueous medium forming an operation environment and the effective thickness has been set to at least the critical thickness of surface decomposition.

6. A downhole tool according to claim 2, wherein an effective thickness has been set to at least 1.5 times of the critical thickness of surface decomposition.

7. A downhole tool according to claim 1, wherein only one of two major surfaces of the shaped body of polyglycolic acid resin is exposed to an aqueous medium forming an operation environment and the effective thickness has been set to at least ½ of the critical thickness of surface decomposition.

8. A downhole tool according to claim 7, wherein the effective thickness has been set to at least ¾ of the critical thickness of surface decomposition.

9. A downhole tool according to claim 1, wherein both of two major surfaces of the shaped body of polyglycolic acid resin are exposed to an aqueous medium forming an operation environment and the effective thickness has been set to at least the critical thickness of surface decomposition.

10. A downhole tool according to claim 1, wherein an effective thickness has been set to at least 1.5 times of the critical thickness of surface decomposition.

11. A downhole tool according to claim 1, wherein the tool is selected from the group consisting of frac plugs, bridge plugs, cement retainers, perforation guns, ball sealers, sealing plugs and packers.

12. A downhole tool according to claim 1, wherein the tool is a ball sealer.

13. A method for formation or repair of a downhole, the method comprising disposing a downhole tool according to claim 1 in a downhole to be formed or repaired, performing an operation for the formation or repair of the downhole within a service life period of the downhole tool determined by the effective thickness of the shaped body of polyglycolic acid having a linear thickness reduction rate with time, and allowing the downhole tool to decay in an environmental aqueous medium in the downhole after the service life period of the downhole tool.

14. A method for formation or repair of a downhole according to claim 13, wherein after the operation, hot steam is injected into the environmental aqueous medium to elevate the temperature of the environmental aqueous medium, thereby accelerating the decay of the downhole tool.

15. A method for formation or repair of a downhole according to claim 13, wherein the tool is selected from the group consisting of frac plugs, bridge plugs, cement retainers, perforation guns, ball sealers, sealing plugs and packers.

16. A downhole tool for hydrocarbon resource recovery having a bar-like entire shape, the tool comprising a connecting member comprising a polyglycolic acid resin, and a plurality of components comprising a material other than polyglycolic acid resin and connected by the connecting member, wherein said connecting member comprises a shaped body of a polyglycolic acid resin having a weight-average molecular weight of at least 70,000, having an effective thickness which is ½ or more of a critical thickness of surface decomposition, and exhibiting a constant thickness reduction rate in water with respect to time.

17. A downhole tool according to claim 16, wherein only one of two major surfaces of the connecting member is exposed to an aqueous medium forming an operation environment and the effective thickness has been set to at least ½ of the critical thickness of surface decomposition.

18. A downhole tool according to claim 17, wherein the effective thickness has been set to at least ¾ of the critical thickness of surface decomposition.

19. A downhole tool according to claim 16, wherein both of two major surfaces of the connecting member are exposed to an aqueous medium forming an operation environment and the effective thickness has been set to at least the critical thickness of surface decomposition.

20. A downhole tool according to claim 19, wherein an effective thickness has been set to at least 1.5 times of the critical thickness of surface decomposition.

21. A downhole tool according to claim 16, wherein said plurality of components comprise a non-water-degradable material.

22. A downhole tool for hydrocarbon resource recovery having a bar-like entire shape, the tool comprising a connecting member comprising a polyglycolic acid resin, and a plurality of components comprising a material other than polyglycolic acid resin and connected by the connecting member, wherein said connecting member comprises a shaped body of a polyglycolic acid resin having a weight-average molecular weight of at least 70,000 and a weight-basis crystallinity of 30-60%, having an effective thickness which is ½ or more of a critical thickness of surface decomposition, and exhibiting a constant thickness reduction rate in water with respect to time.

23. A downhole tool according to claim 22, wherein only one of two major surfaces of the connecting member is exposed to an aqueous medium forming an operation environment and the effective thickness has been set to at least ½ of the critical thickness of surface decomposition.

24. A downhole tool according to claim 23, wherein the effective thickness has been set to at least ¾ of the critical thickness of surface decomposition.

25. A downhole tool according to claim 22, wherein both of two major surfaces of the connecting member are exposed to an aqueous medium forming an operation environment and the effective thickness has been set to at least the critical thickness of surface decomposition.

26. A downhole tool according to claim 25, wherein an effective thickness has been set to at least 1.5 times of the critical thickness of surface decomposition.

27. A downhole tool according to claim 22, wherein said plurality of components comprise a non-water-degradable material.

* * * * *